US012221965B2

(12) United States Patent
Hwang et al.

(10) Patent No.: US 12,221,965 B2
(45) Date of Patent: Feb. 11, 2025

(54) OIL SEPARATOR FOR AN ELECTRIC COMPRESSOR

(71) Applicant: Hanon Systems, Daejeon (KR)

(72) Inventors: Seung Yong Hwang, Daejeon (KR); Duck Bin Yoon, Daejeon (KR); Won Bin Lee, Daejeon (KR); Hak Su Lee, Daejeon (KR); Jun Sig Choi, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/547,639

(22) PCT Filed: Oct. 17, 2022

(86) PCT No.: PCT/KR2022/015763

§ 371 (c)(1),
(2) Date: Aug. 23, 2023

(87) PCT Pub. No.: WO2023/096160

PCT Pub. Date: Jun. 1, 2023

(65) Prior Publication Data

US 2024/0301883 A1 Sep. 12, 2024

(30) Foreign Application Priority Data

Nov. 25, 2021 (KR) ..... 10-2021-0164806

(51) Int. Cl.

| | |
|---|---|
| ***F04C 29/02*** | (2006.01) |
| ***B01D 17/02*** | (2006.01) |
| ***F04B 39/04*** | (2006.01) |
| ***F04C 18/02*** | (2006.01) |
| ***F04C 29/04*** | (2006.01) |

(52) U.S. Cl.

CPC ..... *F04C 29/026* (2013.01); *F04B 39/04* (2013.01); *F04C 29/02* (2013.01); *F04C 2240/30* (2013.01)

(58) Field of Classification Search

CPC ..... F04C 29/02; F04C 29/026; F04C 18/02; B01D 17/02; F04B 39/04

See application file for complete search history.

(56) References Cited

FOREIGN PATENT DOCUMENTS

| | | | | |
|---|---|---|---|---|
| CN | 111156168 A | * | 5/2020 | ..... F04C 29/026 |
| DE | 102018217911 A1 | * | 4/2020 | ..... F01C 21/10 |
| JP | 2014206135 A | | 10/2014 | |
| JP | 2014211101 A | | 11/2014 | |
| KR | 101693043 B1 | * | 6/2010 | ..... F04C 29/02 |

(Continued)

OTHER PUBLICATIONS

English translation of KR101693043 by PE2E Jun. 18, 2024.*

(Continued)

*Primary Examiner* — Deming Wan

(74) *Attorney, Agent, or Firm* — James D. Miller; Shumaker, Loop & Kendrick, LLP

(57) ABSTRACT

An electric compressor, wherein an oil separator is formed on an inner wall on the discharge path, and wherein the oil separator is formed in a concavo-convex shape along a rotation direction of the refrigerant on the discharge path. In the compressor, the farther it is from a discharge hole along a rotation direction of the refrigerant, the greater the depth of a first groove portion formed in an oil separator is. As a result, the oil contained in the refrigerant is separated.

16 Claims, 7 Drawing Sheets

(56) References Cited

FOREIGN PATENT DOCUMENTS

| | | | | | |
|---|---|---|---|---|---|
| KR | 20110138991 | A | * | 6/2010 | ..... F04C 29/02 |
| KR | 20200055298 | A | | 5/2020 | |
| KR | 20200107625 | A | | 9/2020 | |
| WO | 2018185914 | A1 | | 10/2018 | |

OTHER PUBLICATIONS

English translation of DC102018217911 by PE2E Jun. 18, 2024.*
Englsih translation of KR 20110138991 by PE2E Jun. 16, 2024.*
English translation of CN 111156168 by PE2E Jun. 16, 2024.*

* cited by examiner

OIL SEPARATOR FOR AN ELECTRIC COMPRESSOR

CROSS-REFERENCE TO RELATED PATENT APPLICATIONS

This patent application is a United States national phase patent application based on PCT/KR2022/015763 filed on Oct. 17, 2022, which claims the benefit of Korean Patent Application No. 10-2021-0164806 filed on Nov. 25, 2021, the entire disclosures of each of which are hereby incorporated herein by reference.

TECHNICAL FIELD

The present disclosure is designed to separate oil contained in a refrigerant discharged from a compressor, and more particularly, the present disclosure relates to an electric compressor having an improved oil separation performance that separate oil contained in a refrigerant.

BACKGROUND ART

In general, an air-conditioning system provided in a vehicle is composed of a compressor, a condenser, an expansion valve, and an evaporator. The compressor compresses refrigerant gas discharged from the evaporator into a high temperature and high pressure state in which the refrigerant is apt to be liquefied, and transfers it to the condenser. Also, the compressor serves to pump and recirculate the refrigerant such that the air-conditioning continues.

The condenser liquefies the high-temperature and high-pressure refrigerant gas by performing heat exchange between the high-temperature and high-pressure refrigerant gas and outdoor air and cooling it. The expansion valve lowers the temperature and pressure of the liquid refrigerant by adiabatically expanding the liquid refrigerant, thereby making the liquid refrigerant easy to evaporate in the evaporator.

The evaporator absorbs heat by performing heat exchange between the liquid refrigerant and the outdoor air introduced into the interior, and evaporates and vaporizes the liquid refrigerant. The outdoor air is cooled by losing the heat to the refrigerant, and is blown into the interior of the vehicle by a blower.

The compressor includes a reciprocating type compressor that actually compresses a working fluid (refrigerant) while performing a reciprocating motion and a rotary type compressor that actually compresses the working fluid while performing a rotational motion. The reciprocating type compressor includes a crank type compressor in which the driving force of a driving source is transmitted to a plurality of pistons using a crank, a swash plate type compressor in which a swash plate is installed, and a wobble plate type compressor in which a wobble plate is used.

For example, a scroll compressor is a type of a rotary compressor, and refers to a compressor in which compression is performed by that two interlocking scrolls having an involute tooth profile rotate.

The scroll compressor is operated while a relative rotation is performed between an orbiting scroll and a fixed scroll which have a 180-degree phase difference geometrically within a discharge chamber. The orbiting scroll and the fixed scroll have scroll-shaped wraps, and the wrap has involute curves with the same shape.

In the scroll compressor, a crescent-shaped compression chamber is formed by the interlocking of the orbiting scroll and the fixed scroll, and then a compression cycle is formed. The compression chamber is formed in a shape of which the volume increases toward the outside and decreases toward the center. A suction chamber is formed on the outside and a discharge port is formed in the center.

In the scroll compressor, the size of the compression space is gradually reduced toward the discharge port by suction gas sealed within a sealed space with a given volume on the outer periphery of the scroll and by relative rotation of the scroll, and the refrigerant is discharged through the discharge port.

The refrigerant discharged from the discharge chamber is centrifuged while passing through an oil separator, and then is finally discharged through the discharge port.

A conventional oil separator is manufactured by forming a discharge path having a predetermined depth by performing a drilling machining into a rear housing provided in the scroll compressor, and then by inserting an oil ring into the oil separator.

In this case, a separation efficiency of oil is degraded in a process in which the oil is introduced into the oil separator and then moves through the discharge path. Accordingly, there occurs a problem that the oil remains in the refrigerant and moves to the evaporator.

In this case, an evaporation efficiency of the refrigerant in the evaporator is degraded, which causes a problem of affecting the efficiency of the compressor.

SUMMARY

The purpose of the present invention is to provide an electric compressor capable of molding an oil separator integrated in a rear housing by inserting in advance an oil separator structure forming means having an oil separator shape into the rear housing when the rear housing is manufactured by cast molding, and by easily separating the oil separator structure forming means when the casting of the rear housing is finished.

One embodiment is an electric compressor including: a front housing configured to form an outer shape and to be formed at a position of a suction port into which a refrigerant is sucked; a compression unit configured to receive a rotational force generated by a driving unit and to compress the refrigerant; and an oil separator configured to include a discharge chamber in which the refrigerant compressed by the compression unit stays and a rear housing in which a discharge path to which the refrigerant in the discharge chamber is discharged to the outside is formed. An oil separator is formed on an inner wall on the discharge path. The oil separator is formed in a concavo-convex shape along a rotation direction of the refrigerant on the discharge path.

A depth of a portion of the oil separator formed in a concavo-convex shape along the rotation direction of the refrigerant is varied.

The depth of a portion of the oil separator formed in a concavo-convex shape along the rotation direction of the refrigerant is increased.

The oil separator extends to be inclined inwardly as it goes down in a longitudinal direction.

The rear housing is provided with an oil separation plate which is positioned over the oil separator and additionally separates oil contained in the refrigerant.

A catching protrusion on which the oil separation plate is seated is formed in the rear housing.

The oil separation plate includes: a main body portion which has an open upper surface; and a refrigerant passage hole which is formed on an inner bottom surface of the main body portion such that gaseous refrigerant with oil removed through the oil separator moves.

The refrigerant passage hole is formed to have an inner diameter which increases from a bottom surface to a top surface of the main body portion.

The main body portion further includes an auxiliary oil separator groove formed in an inner longitudinal direction.

In the rear housing, a bush is disposed on a top surface of the oil separation plate.

The bush has an opening hole formed therein that allows the refrigerant to pass therethrough. The opening hole has an inner diameter smaller than that of the oil separation plate.

An inner bottom surface of the oil separation plate is formed in a mesh shape.

The oil separators are disposed below the rear housing and face each other on the basis of a discharge hole formed in the rear housing. The oil separation plate is disposed above and apart from the discharge hole.

The compressed refrigerant flows to the oil separator through the discharge hole formed in the rear housing.

The oil separator is formed by an oil separation structure forming means when the rear housing is cast.

The oil separation structure forming means includes: a first body portion in which a communication hole that forms an overall outer shape and communicates with the discharge hole is formed and in which a groove portion and a protrusion are repeatedly formed in the longitudinal direction; a second body portion that extends above the first body portion and has a relatively larger outer diameter than that of the first body portion; and a catching protrusion forming part formed at a lower inner portion of the second body portion.

The oil separator includes: a first groove portion which is cast together with the oil separation structure forming means and is formed at a position corresponding to the protrusion in an inside of a discharge wall forming an overall outer shape; and a first protrusion which is formed at a position corresponding to the groove portion of the oil separation structure forming means.

The oil separator includes: a first section which extends from the communication hole to a lower end of the first body portion in an entire section in the longitudinal direction; and a second section which extends by a predetermined length from a top of the first section to an upper side end of the second body portion.

According to the embodiments, when the rear housing is molded by a casting method, the oil separator can be molded by the oil separator structure forming means. Accordingly, it is possible to obtain convenience of manufacturing and is possible to reduce the manufacturing cost through the elimination of a drilling process.

According to the embodiments, when oil separation is performed through the oil separator structure forming means, the oil contained in the refrigerant is moved and separated while a contact area thereof is increased, so that the oil separation efficiency is improved.

According to the embodiments, after the refrigerant discharged from the compressor is introduced, the oil contained in the refrigerant is separated by the principle of centrifugation, and only the refrigerant gas can be moved through the discharge hole, so that the oil separation efficiency is improved.

DETAILED DESCRIPTION OF EMBODIMENTS

Figure 1:
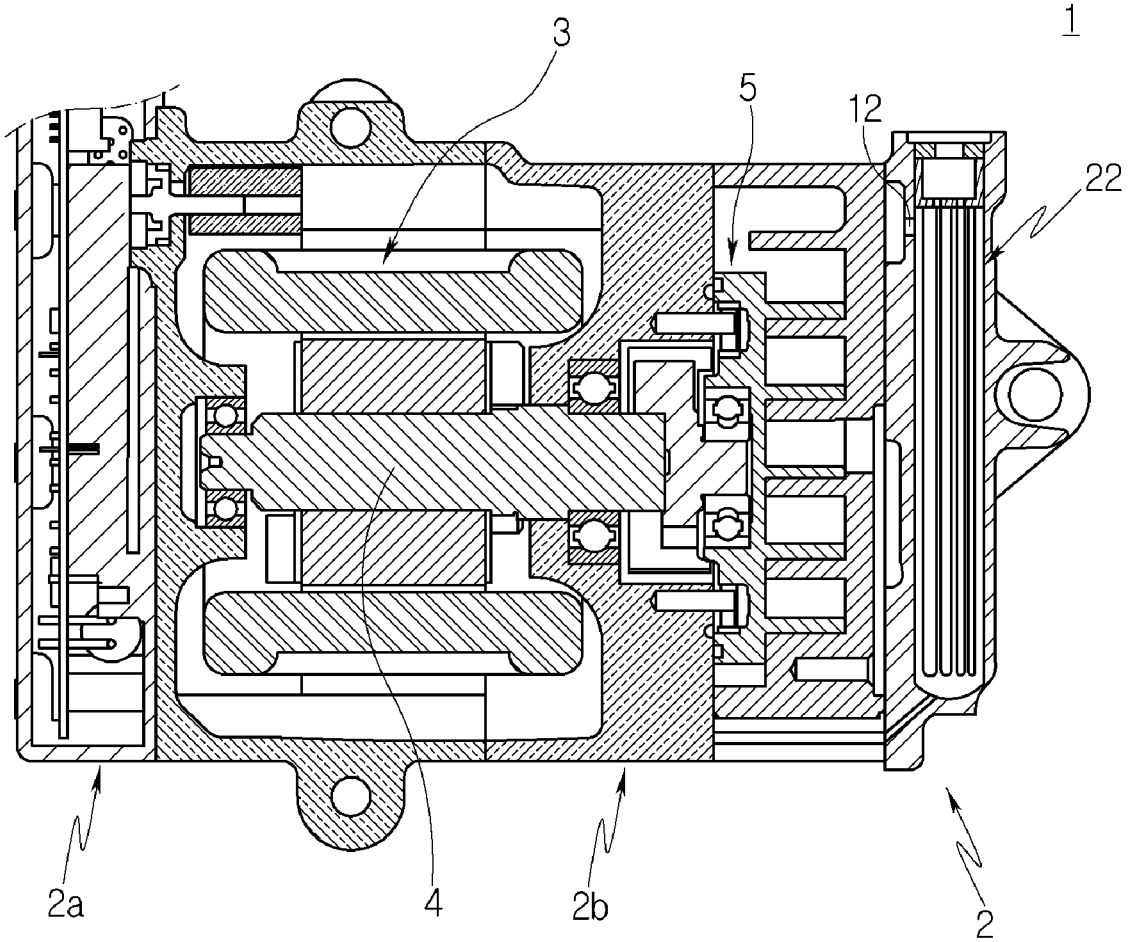
FIG. 1 is a longitudinal sectional view of an electric compressor according to an embodiment of the present disclosure.

As the present invention can have various embodiments as well as can be diversely changed, specific embodiments will be illustrated in the drawings and described in detail. While the present invention is not limited to particular embodiments, all modification, equivalents and substitutes included in the spirit and scope of the present invention are understood to be included therein. The thickness of lines or the size of the component, etc., shown in the accompanying drawings may be exaggerated for clarity and convenience of description.

Also, the below-mentioned terms are defined in consideration of the functions in the present invention and may be changed according to the intention of users or operators or judicial precedents. Therefore, definitions of such terms should be made based on what has been described throughout the present specification.

Figure 2:
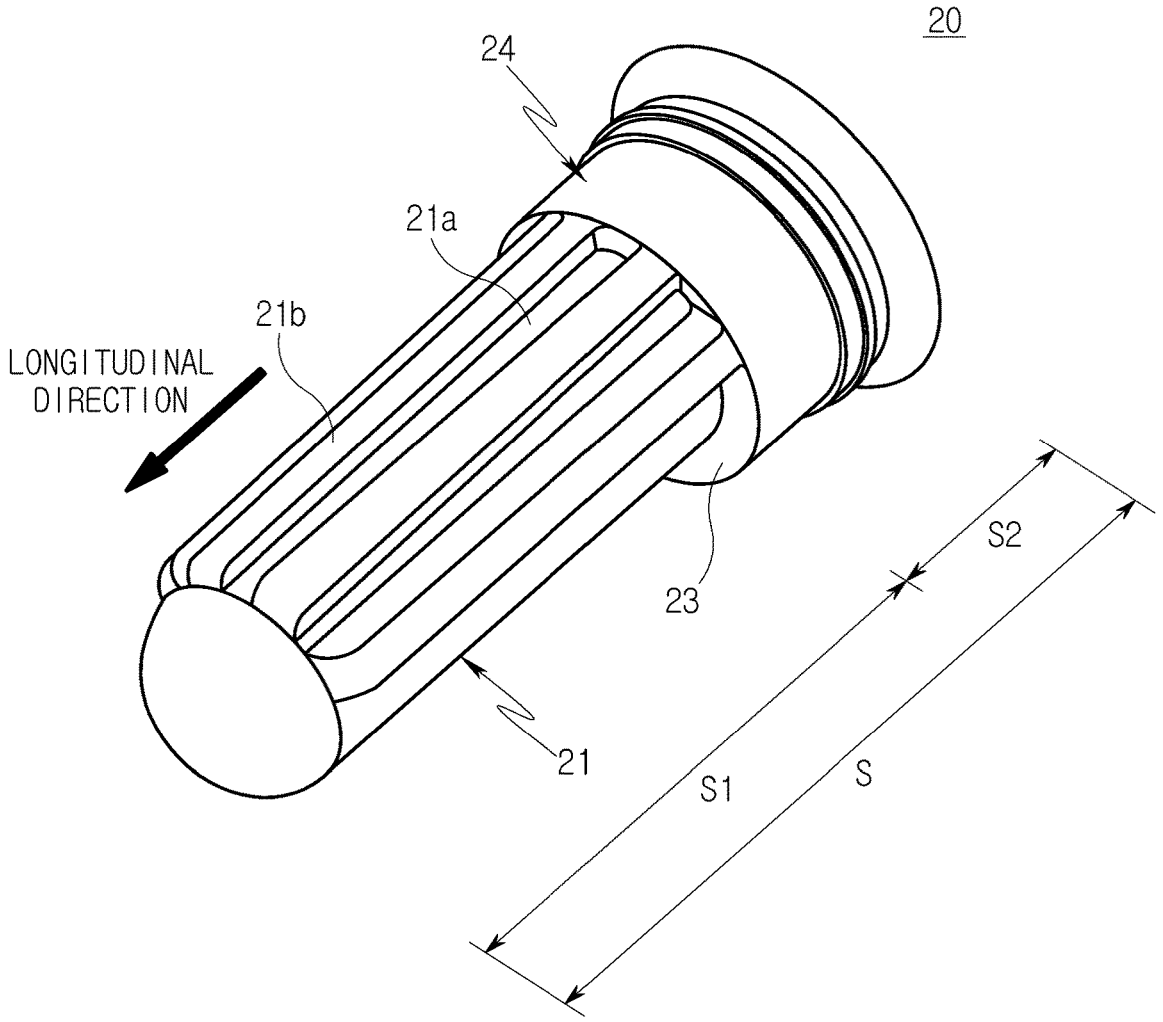
FIG. 2 is a perspective view an oil separation structure forming means according to the embodiment of the present disclosure.
Figure 3:
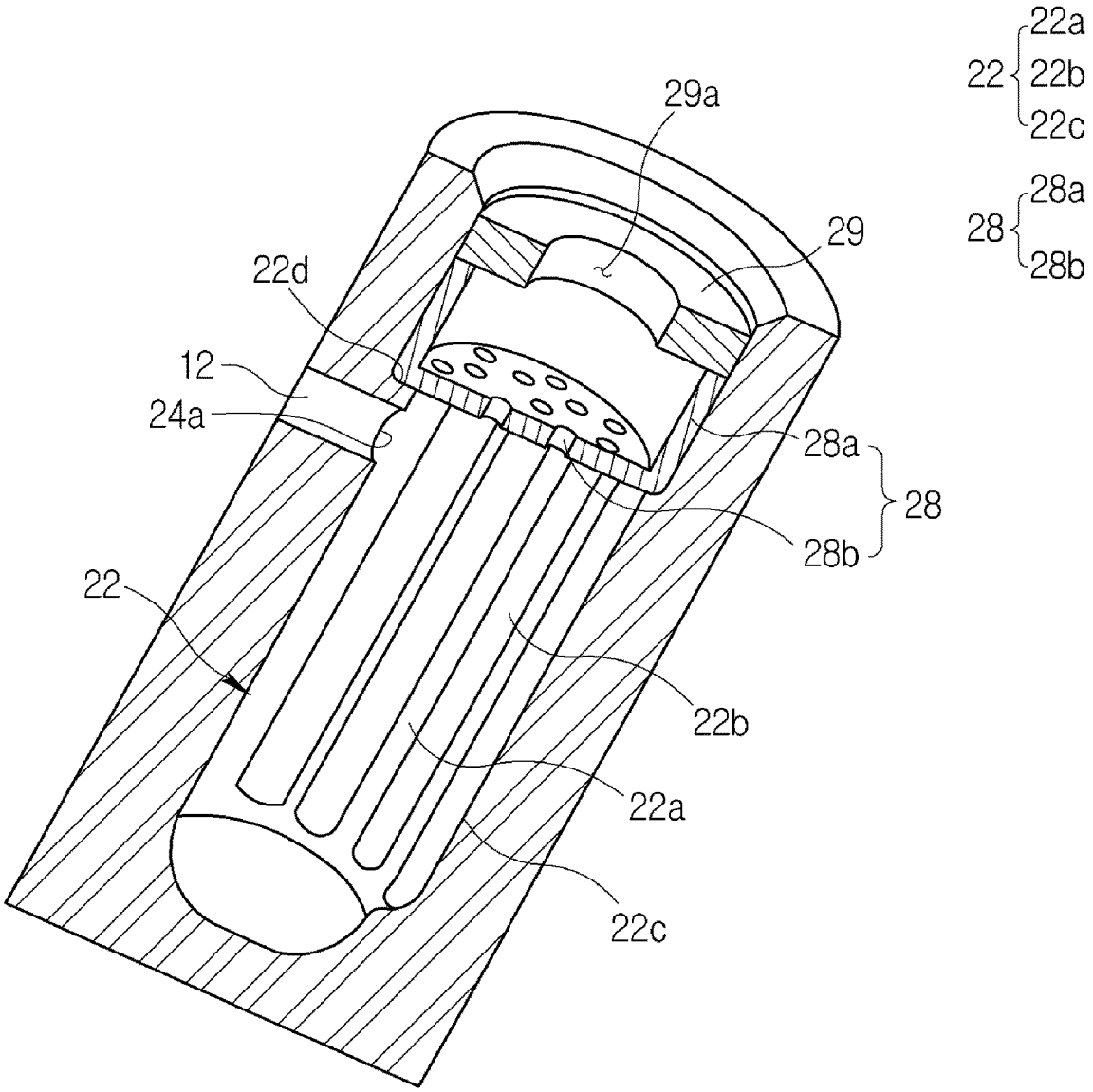
FIG. 3 is a longitudinal sectional view of a rear housing provided with an oil separator and main components according to the embodiment of the present disclosure.
Figure 4:
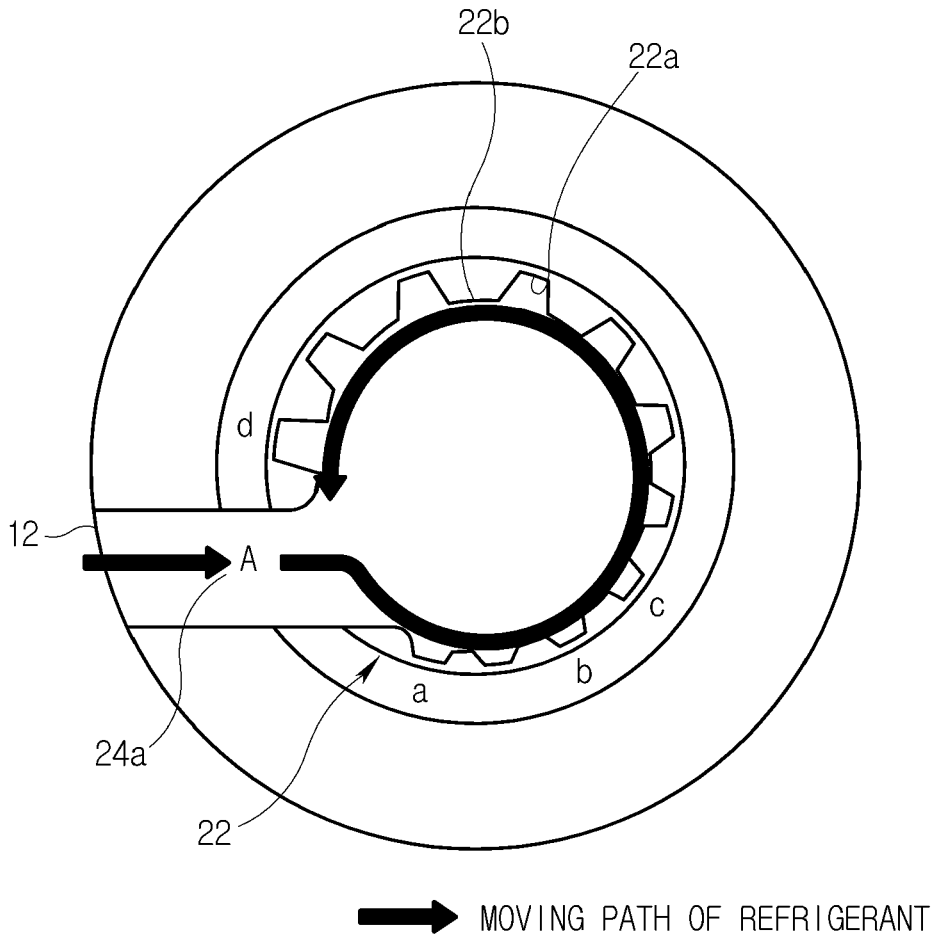
FIG. 4 is a view showing a path for a refrigerant to travel inside of the rear housing according to the embodiment of the present disclosure.
Figure 5:
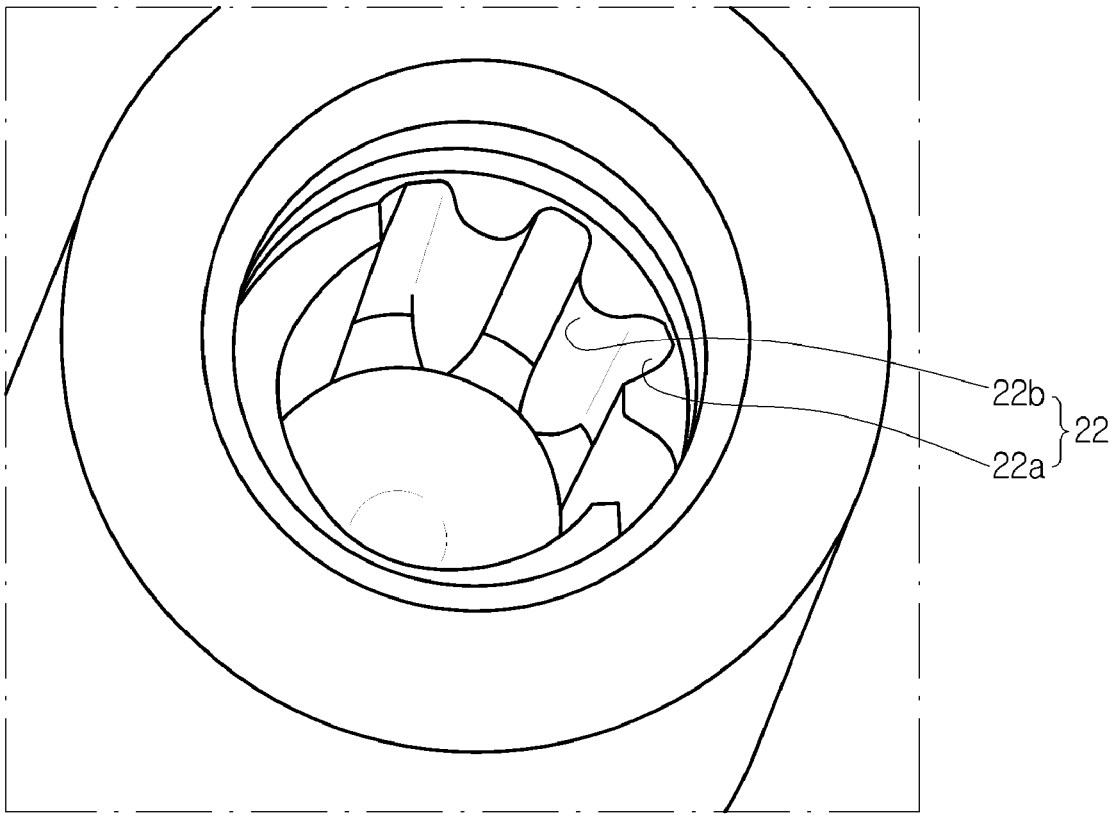
FIG. 5 is a view showing an inside of the rear housing according to the embodiment of the present disclosure.

An electric compressor according to an embodiment of the present disclosure will be described with reference to the drawings. For reference, FIG. 1 is a longitudinal sectional view of an electric compressor according to an embodiment of the present disclosure. FIG. 2 is a perspective view an oil separation structure forming means according to the embodiment of the present disclosure. FIG. 3 is a longitudinal sectional view of a rear housing provided with an oil separator and main components according to the embodiment of the present disclosure. FIG. 4 is a view showing a path for a refrigerant to travel inside of the rear housing according to the embodiment of the present disclosure. FIG. 5 is a view showing an inside of the rear housing according to the embodiment of the present disclosure.

Referring to FIGS. 1 to 5, an electric compressor 1 according to the embodiment includes a front housing 2*a* configured to form an outer shape and to be formed at a position of a suction port into which a refrigerant is sucked, a middle housing 2*b*, and a rear housing 2. A driving unit 3 and a compression unit 5 are built into the middle housing 2*b*. Also, the drive unit 3 includes a stator, a rotor, and a rotating shaft 4 inserted into the center of the rotor.

The drive unit 3 generates a rotational force and transmits it to the compression unit 5. The refrigerant is compressed and discharged by the compression unit 5. The compression unit 5 includes a fixed scroll and an orbiting scroll. The fixed scroll is maintained in a fixed state, and the orbiting scroll is installed to be eccentrically rotatable with respect to the fixed scroll and compresses the refrigerant while performing a relative movement with respect to the fixed scroll.

The rear housing 2 is positioned at one side end of the middle housing 2*b*, and more specifically, the rear housing 2 is selectively detachably mounted to the middle housing 2*b* while being coupled to the right side end on the basis of the drawing.

The refrigerant discharged from the compression unit 5 is moved through a discharge hole 12 formed in the rear housing 2 after being discharged by the compression unit 5. Then, while the refrigerant is rotated along an oil separator 22, oil contained in the refrigerant is separated.

In particular, in the embodiment, when the oil separator 22 is molded on the rear housing 2 by a casting method by using an oil separation structure forming means 20, the oil separation structure forming means is placed inside the rear housing 2 and is molded together, thereby improving the workability of an operator.

Also, in the embodiment, after the rear housing 2 is cast by using the oil separation structure forming means 20, additional work is minimized. Since it is easy to manage a tolerance for a space where oil separation occurs when the rear housing 2 is manufactured, design flexibility can be improved.

The oil separation structure forming means 20 is used to form, on the rear housing 2, the oil separator 22 capable of separating oil.

In particular, in the embodiment, when the rear housing 2 is molded, the operator can easily insert the oil separation structure forming means 20, so that the manufacturability is improved and additional work such as a drilling process is unnecessary, thereby reducing the manufacturing cost and enhancing the workability of the operator.

The oil separation structure forming means 20 extends to have a length and structure shown in the drawing such that the oil separator 22 in which foreign substances included in the oil are separated is formed. When the oil separation structure forming means is separated after all casting of the rear housing 2 is finished even without performing additional work on the rear housing 2 through a drilling process, an additional drilling process is not required, thereby reducing the manufacturing cost and enhancing the workability of the operator.

As shown in the drawing, the oil separation structure forming means 20 is formed as a cylindrical space formed with a predetermined length. The length extending in the axial direction may be variously changed.

The oil separation structure forming means 20 according to the embodiment includes a first body portion 21 in which a communication hole 24*a* that forms an overall outer shape and communicates with the discharge hole 12 is formed and in which a groove portion 21*a* and a protrusion 21*b* are repeatedly formed in the longitudinal direction, a second body portion 24 that extends above the first body portion 21 and has a relatively larger outer diameter than that of the first body portion 21, and a catching protrusion forming part 23 formed at a lower inner portion of the second body portion.

The first body portion 21 extends relatively longer than the second body portion 24. The second body portion 24 has a relatively larger outer diameter than that of the first body portion 21. The catching protrusion forming part 23 having a structure in which an oil separation plate 28 to be described later is seated is formed at a lower inner portion of the second body portion.

The first body portion 21 is formed in the form shown in the drawing in such a way as to be easily inserted into and separated from the rear housing 2. The groove portion 21*a* and the protrusion 21*b* extend by a length shown in the drawing in the longitudinal direction in the form in which they are repeated along the circumferential direction.

The first body portion 21 molds, through the groove portion 21*a* and the protrusion 21*b*, the oil separator 22 to be described later. The first body portion 21 may induce the oil contained in the refrigerant to be separated by the groove portion 21*a* and the protrusion 21*b*.

The oil separation structure forming means 20 includes a first section S1 and a second section S2. The first section S1 corresponds to a section extending in the longitudinal direction to the lower end of the first body portion 21 in the entire section S extending in the longitudinal direction. The second section S2 corresponds to a section extending by a predetermined length from a top of the first section S1 to an upper side end of the second body portion 24.

The oil separation structure forming means 20 is divided into the first section S1 and the second section S2 on the basis of the catching protrusion forming part 23. Therefore, after the oil separation structure forming means is positioned in the rear housing 2, the position does not change during the casting process. In addition, even when the operator places the oil separation structure forming means within the rear housing 2, the oil separation structure forming means can be installed without incorrect installation.

bed,oil separator 22 includes a first groove portion 22*a* and a first protrusion 22*b*. The first groove portion 22*a* is cast together with the oil separation structure forming means 20 and is formed at a position corresponding to the protrusion 21*b* in the inside of a discharge wall 22*c* forming the overall outer shape. The first protrusion 22*b* is formed at a position corresponding to the groove portion 21*a* of the oil separation structure forming means 20.

The first groove portion 22*a* and the first protrusion 22*b* are formed inside the discharge wall 22*c*, and the depth of the first groove portion 22*a* increases along the rotation direction of the refrigerant. Therefore, due to collision and contact, in the oil contained in the refrigerant, oil with a heavy specific gravity moves downward and only the gaseous refrigerant with a relatively light specific gravity is easily separated. A more detailed description of the oil separator 22 will be described later.

When the rear housing 2 is molded together with the oil separation structure forming means 20 by a casting method, the oil separator 22 (see FIGS. 4 and 5) is easily formed therewithin. Accordingly, the rear housing 2 having the oil separator 22 can be manufactured through one-time cast molding without additional work for oil separation.

The rear housing 2 is provided with the oil separation plate 28. The oil separation plate 28 is positioned over the oil separator 22 and additionally separates the oil contained in the refrigerant. Since the oil separation plate 28 can be seated on a catching protrusion 22*d*, the position of the oil separation plate 28 is fixed simultaneously with its insertion, thereby making it easier to install the oil separation plate.

The oil separation plate 28 is provided to additionally separate the oil contained in the refrigerant that has not been separated by the oil separator 22.

The oil separation plate 28 includes a main body portion 28*a* and a refrigerant passage hole 28*b*. The main body portion 28*a* has an open upper surface and a cylindrical shape. The refrigerant passage hole 28*b* is formed on the inner bottom surface of the main body portion 28*a* such that the gaseous refrigerant with oil removed through the oil separator 22 moves.

As shown in the drawing, the refrigerant passage hole 28*b* has a predetermined diameter and a plurality of the refrigerant passage holes 28*b* is arranged at regular intervals. As the refrigerant gas passes through the refrigerant passage hole, an excess speed of the refrigerant gas is reduced, inducing the unseparated oil to be separated from the refrigerant gas.

Resistance to the movement of the refrigerant gas is not generated before the refrigerant gas passes through the oil separation plate 28. However, as the refrigerant gas passes through the plurality of refrigerant passage holes 28*b*, the moving speed is reduced and the oil is separated, and residual oil in the refrigerant gas can be further separated.

In the rear housing 2, a bush 29 is disposed on the top surface of the oil separation plate 28. For example, the bush 29 is formed in a ring shape, so that the oil separation plate 28 can further separate the unseparated extra oil.

The bush 29 has an opening hole 29*a* formed therein that allows the refrigerant to pass therethrough. The opening hole 29*a* has an inner diameter smaller than that of the oil separation plate 28, so that additional oil separation can be performed.

In particular, since the refrigerant gas collides with the bottom surface of the bush 29 rather than passing through the bush 29 as it is and then moves through the opening hole 29*a*, it is possible to induce the falling movement of the oil more easily.

The bush 29 can also be threaded on the outside in order to make it easier for the operator to assemble.

In the rear housing 2, when the casting operation is completed by the oil separation structure forming means 20, the oil separators 22 are formed within the rear housing 2 and face each other on the basis of the discharge hole 12. The oil separation plate 28 is mounted above and apart from the discharge hole 12.

The farther it is from the discharge hole 12 along the rotation direction of the refrigerant, the greater the depth of the oil separator 22 is. Therefore, the oil contained in the refrigerant can be stably separated through an increase in the rotational force and contact area of the oil.

The refrigerant includes a pure gaseous refrigerant and oil. The oil contained in the refrigerant is moved to the rear housing 2 and then is separated into refrigerant gas and oil. Some foreign substances contained in the oil are moved downward together with the oil.

After the refrigerant is introduced through the discharge hole 12, the refrigerant has a centrifugal force at a predetermined speed from the inner circumferential direction toward a direction "A" further away from the discharge hole 12 and rotates while contacting the oil separator 22.

As shown in the cross-sectional view, in the oil separator 22, the depth of the first groove portion 22*a* gradually increases along the discharge wall 22*c* from a position adjacent to the discharge hole 12 toward the rotation direction of the refrigerant. Therefore, after the oil contained in the refrigerant is introduced into the first groove portion 22*a*, the oil can easily move downward in the direction of gravity while colliding with the inner surface.

The oil separator 22 is formed as described above because when the refrigerant passes through the communication hole 24*a* via the discharge hole 12 and the depth at a position "a" of the oil separator 22 is formed as shown in the drawing, the oil separation is more smoothly performed due to the diffusion of the refrigerant at the position and increase in a contact area with the inner surface.

In the embodiment, in order to maximize the effect, the depth is gradually increased while moving from the position "a" to positions "b" and "c." Accordingly, due to the centrifugal force by the rotation and gradual increase in the contact area with the refrigerant, it is possible to stably induce the centrifugation and the separation efficiency of the oil contained in the refrigerant can be improved accordingly.

For example, while the refrigerant moves along the rotational direction, the contact area of the oil separator 22 increases the most at a position "d". Therefore, the refrigerant collides and the oil with a heavy specific gravity moves downward in the direction of gravity. Then, the oil is moved to a back pressure chamber and a suction chamber through a separately formed passage (not shown) by a differential pressure.

The oil separator 22 extends to be inclined inwardly as it goes down in the longitudinal direction, thereby improving the downward mobility of the oil contained in the refrigerant and improving the oil separation efficiency.

Figure 6:
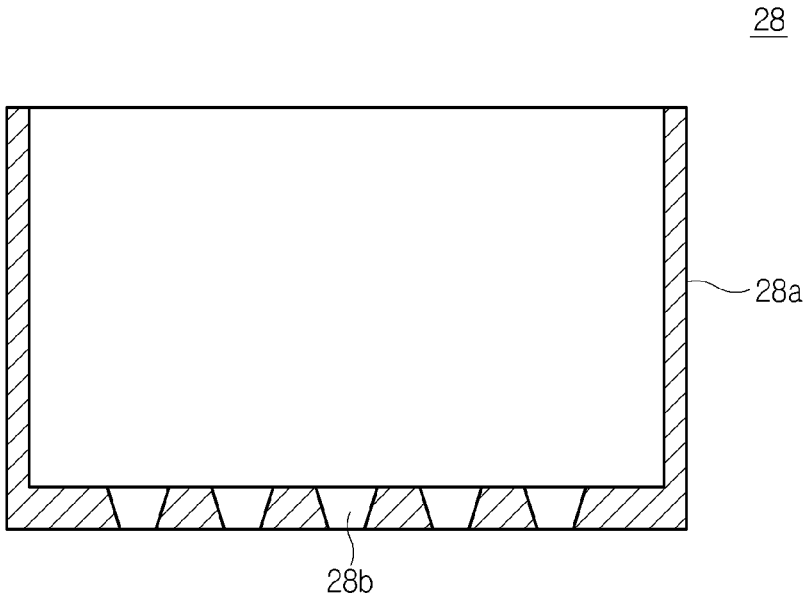
FIG. 6 is a longitudinal sectional view of an oil separation plate according to the embodiment of the present disclosure.

Referring to the attached FIG. 6, the refrigerant passage hole 28*b* according to the embodiment is formed to have a constant inner diameter or an inner diameter which increases from the bottom surface to the top surface of the main body portion 28*a*.

When the inner diameter of the refrigerant passage hole 28*b* increases as described above, the moving speed of the refrigerant gas is reduced, and oil can be additionally separated through surface contact with the inner surface of the refrigerant passage hole 28*b*, so that the oil separation efficiency can be further improved.

The oil separation plate 28 extends a predetermined length upward from the inner bottom surface of the main body portion 28*a* and a space is formed therein. While the refrigerant gas is diffused in the space, the oil contained in the refrigerant gas that has passed through the refrigerant passage hole 28*b* can be additionally separated.

Figure 7:
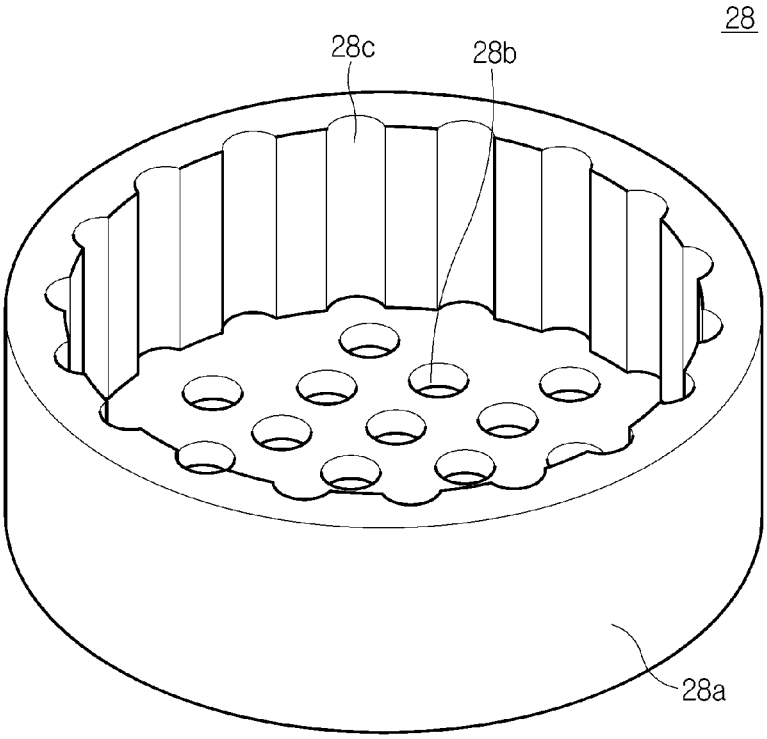
FIG. 7 is a perspective view showing another example of the oil separation plate according to the embodiment of the present disclosure.

Referring to the attached FIG. 7, the main body portion 28*a* according to the embodiment further includes an auxiliary oil separation groove 28*c* formed in an inner longitudinal direction. The auxiliary oil separation groove 28*c* induces the extra oil contained in the refrigerant gas that has passed through the aforementioned refrigerant passage hole 28*b* to be separated through surface contact with the auxiliary oil separation groove 28*c*.

Figure 8:
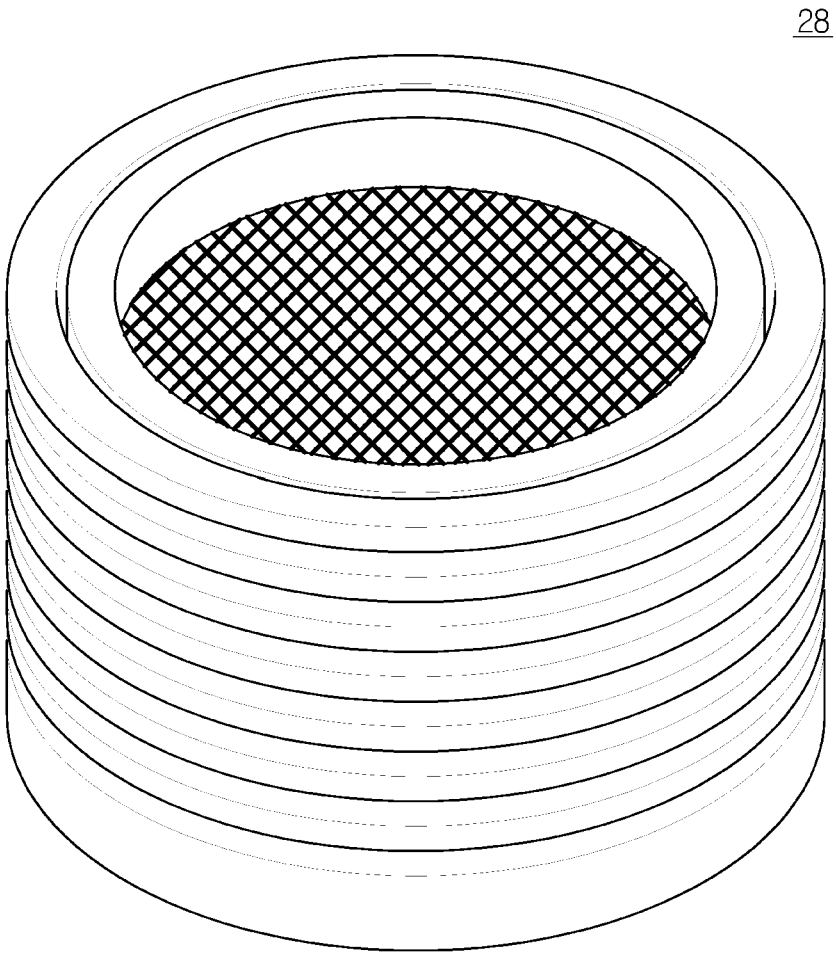
FIG. 8 is a perspective view showing that an inside of the oil separation plate is formed in a mesh form according to the embodiment of the present disclosure.

Referring to the attached FIG. 8, the inner bottom surface of the oil separation plate 28 according to the embodiment is formed in a mesh shape. As such, when the oil separation plate 28 is formed in a mesh shape, the separation efficiency of the oil contained in the refrigerant gas can be improved due to the dense spacing.

While the one embodiment of the present invention has been described, it is possible for those skilled in the art to make various changes and modifications of the forms and details of the present invention by means of addition, change, elimination or supplement, etc., of the components of the present invention without departing from the spirit of the present invention as defined by the appended claims, which also belongs to the scope of rights of the present invention.

The embodiments can be applied and used in the electric compressor that requires the oil separation.

The invention claimed is:

1. An electric compressor comprising:

a front housing configured to form an outer shape and to be formed at a position of a suction port into which a refrigerant is sucked;

a compression unit configured to receive a rotational force generated by a driving unit and to compress the refrigerant; and an oil separator configured to comprise a discharge chamber in which the refrigerant compressed by the compression unit stays and a rear housing in which a discharge path to which the refrigerant in the discharge chamber is discharged to an outside is formed, wherein the oil separator is formed on an inner wall on the discharge path, and wherein the oil separator is formed in a concavo-convex shape along a rotation direction of the refrigerant on the discharge path, wherein the rear housing is provided with an oil separation plate which is positioned over the oil separator and additionally separates oil contained in the refrigerant, wherein a catching protrusion on which the oil separation plate is seated is formed in the rear housing.

2. The electric compressor of claim 1, wherein a depth of a portion of the oil separator formed in the concavo-convex shape along the rotation direction of the refrigerant is varied.

3. The electric compressor of claim 2, wherein the depth of the portion of the oil separator formed in the concavo-convex shape along the rotation direction of the refrigerant is increased.

4. The electric compressor of claim 3, wherein the oil separator extends to be inclined inwardly as it goes down in a longitudinal direction.

5. The electric compressor of claim 1, wherein the oil separation plate further comprises:

a main body portion which has an open upper surface; and a refrigerant passage hole which is formed on an inner bottom surface of the main body portion such that gaseous refrigerant with the oil removed through the oil separator moves.

6. The electric compressor of claim 5, wherein the refrigerant passage hole is formed to have an inner diameter which increases from a bottom surface to the upper surface of the main body portion.

7. The electric compressor of claim 6, wherein the main body portion further comprises an auxiliary oil separator groove formed in an inner longitudinal direction.

8. The electric compressor of claim 1, wherein the oil separator is formed by an oil separation structure forming means when the rear housing is cast.

9. The electric compressor of claim 8, wherein the oil separation structure forming means further comprises:

a first body portion in which a communication hole that forms an overall outer shape and communicates with a discharge hole is formed and in which a groove portion and a protrusion are repeatedly formed in a longitudinal direction;

a second body portion that extends above the first body portion and has a relatively larger outer diameter than that of the first body portion; and a catching protrusion forming part formed at a lower inner portion of the second body portion.

10. The electric compressor of claim 9, wherein the oil separator further comprises:

a first groove portion which is cast together with the oil separation structure forming means and is formed at a position corresponding to the protrusion in an inside of a discharge wall forming an overall outer shape; and a first protrusion which is formed at a position corresponding to the groove portion of the oil separation structure forming means.

11. The electric compressor of claim 9, wherein the oil separator further comprises:

a first section which extends from the communication hole to a lower end of the first body portion in an entire section in the longitudinal direction; and a second section which extends by a predetermined length from a top of the first section to an upper side end of the second body portion.

12. An electric compressor comprising:

a front housing configured to form an outer shape and to be formed at a position of a suction port into which a refrigerant is sucked;

a compression unit configured to receive a rotational force generated by a driving unit and to compress the refrigerant; and an oil separator configured to comprise a discharge chamber in which the refrigerant compressed by the compression unit stays and a rear housing in which a discharge path to which the refrigerant in the discharge chamber is discharged to an outside is formed, wherein the oil separator is formed on an inner wall on the discharge path, and wherein the oil separator is formed in a concavo-convex shape along a rotation direction of the refrigerant on the discharge path, wherein the rear housing is provided with an oil separation plate which is positioned over the oil separator and additionally separates oil contained in the refrigerant, wherein, in the rear housing, a bush is disposed on a top surface of the oil separation plate.

13. The electric compressor of claim 12, wherein the bush has an opening hole formed therein that allows the refrigerant to pass therethrough, and wherein the opening hole has an inner diameter smaller than that of the oil separation plate.

14. The electric compressor of claim 13, wherein an inner bottom surface of the oil separation plate is formed in a mesh shape.

15. An electric compressor comprising:

a front housing configured to form an outer shape and to be formed at a position of a suction port into which a refrigerant is sucked;

a compression unit configured to receive a rotational force generated by a driving unit and to compress the refrigerant; and an oil separator configured to comprise a discharge chamber in which the refrigerant compressed by the compression unit stays and a rear housing in which a discharge path to which the refrigerant in the discharge chamber is discharged to an outside is formed, wherein the oil separator is formed on an inner wall on the discharge path, and wherein the oil separator is formed in a concavo-convex shape along a rotation direction of the refrigerant on the discharge path, wherein the rear housing is provided with an oil separation plate which is positioned over the oil separator and additionally separates oil contained in the refrigerant, wherein the oil separator is disposed below the rear housing on the basis of a discharge hole formed in the rear housing, and wherein the oil separation plate is disposed above and apart from the discharge hole.

16. The electric compressor of claim 15, wherein the refrigerant which is compressed flows to the oil separator through the discharge hole formed in the rear housing.

* * * * *